US010821326B2

(12) United States Patent
Hwang et al.

(10) Patent No.: US 10,821,326 B2
(45) Date of Patent: Nov. 3, 2020

(54) GOLF BALL

(71) Applicant: VOLVIK INC., Chungcheongbuk-do (KR)

(72) Inventors: In Hong Hwang, Namyangju-si (KR); Kyung Ahn Moon, Seoul (KR)

(73) Assignee: VOLVIK INC., Chungcheongbuk-do (KR)

( * ) Notice: Subject to any disclaimer, the term of this patent is extended or adjusted under 35 U.S.C. 154(b) by 0 days.

(21) Appl. No.: 16/131,653

(22) Filed: Sep. 14, 2018

(65) Prior Publication Data

US 2020/0047034 A1 Feb. 13, 2020

(30) Foreign Application Priority Data

Aug. 13, 2018 (KR) ..... 10-2018-0094478

(51) Int. Cl.
*A63B 37/12* (2006.01)
*A63B 37/00* (2006.01)
*A63B 102/32* (2015.01)

(52) U.S. Cl.
CPC ..... *A63B 37/0012* (2013.01); *A63B 37/002* (2013.01); *A63B 37/0006* (2013.01); *A63B 37/0019* (2013.01); *A63B 2102/32* (2015.10)

(58) Field of Classification Search
CPC ..... A63B 37/0011; A63B 37/0012
USPC ..... 473/383, 384
See application file for complete search history.

(56) References Cited

U.S. PATENT DOCUMENTS 4,560,168 A 12/1985 Aoyama
5,547,197 A * 8/1996 Pocklington ..... A63B 37/0004 473/384
5,879,245 A * 3/1999 Hwang ..... A63B 37/0004 473/384
5,957,787 A 9/1999 Hwang
6,709,349 B2 3/2004 Sullivan
7,250,012 B1 * 7/2007 Simonds ..... A63B 37/0004 473/383
2012/0302377 A1 11/2012 Sato et al.

FOREIGN PATENT DOCUMENTS

JP 2008-220791 A 9/2008

* cited by examiner

*Primary Examiner* — Raeann Gorden
(74) *Attorney, Agent, or Firm* — Rabin & Berdo, P.C.

(57) ABSTRACT

Provided is a golf ball with air channels between adjacent dimples. The golf ball according to the present disclosure has air channels connecting adjacent dimples, and an outer tip of the air channel is chamfered or filleted. The problem of durability deterioration at the outer tip of the air channel over the entire surface of the golf ball is solved by the air channel structure in which the outer tip is chamfered or filleted. Meanwhile, it is possible to minimize the influence of wind at the outer tip of the air channel and greatly improve flight stability related with slice prevention, straightness and excellent impact point while ensuring a sufficient flight distance by uniformalizing pressure drag. In addition, the depth of the dimple itself is selectively made larger than the depth of the dimple of the conventional golf ball with the air channel in accordance with the chamfering or filleting of the outer tip of the air channel, thereby minimizing lift force and a loss of a flight distance.

7 Claims, 12 Drawing Sheets

| | CLUB SPEED mph | BALL SPEED mph | LAUNCH ANG. deg | SPIN RATE rpm | HEIGHT m | LAND. ANG. deg | CARRY m | TOTAL m | HANG TIME s |
|---|---|---|---|---|---|---|---|---|---|
| Average | 91.3 | 133.3 | 13.7 | 2693 | 24.0 | 38.0 | 187.5 | 207.3 | 5.90 |

Air channel Dimple 332
(Dimple depth 0.205mm, Channel depth 0.075mm with Fillet Radius R=0.05mm)

| | CLUB SPEED mph | BALL SPEED mph | LAUNCH ANG. deg | SPIN RATE rpm | HEIGHT m | LAND. ANG. deg |
|---|---|---|---|---|---|---|
| Average | 91.7 | 131.8 | 18.0 | 2506 | 24.3 | 34.7 |

| | CARRY m | SIDE m | TOTAL m | HANG TIME s | CLUB PATH deg | FACE ANG. deg |
|---|---|---|---|---|---|---|
| Average | 178.4 | 3.2R | 205.3 | 4.81 | -2.7 | -1.9 |

1st Air channel Dimple 332
(Dimple depth 0.168mm, Channel depth 0.05mm with Fillet Radius R=0.1mm)

| | CLUB SPEED mph | BALL SPEED mph | LAUNCH ANG. deg | SPIN RATE rpm | HEIGHT m | LAND. ANG. deg | CARRY m | TOTAL m | HANG TIME s |
|---|---|---|---|---|---|---|---|---|---|
| Average | 90.2 | 132.8 | 14.6 | 2702 | 24.6 | 35.8 | 193.6 | 218.5 | 5.71 |

3rd Air channel Dimple 332
(Dimple depth 0.195mm, Channel depth 0.09mm with Fillet Radius R=0.1mm)

| | CLUB SPEED mph | BALL SPEED mph | LAUNCH ANG. deg | SPIN RATE rpm | HEIGHT m | LAND. ANG. deg |
|---|---|---|---|---|---|---|
| Average | 91.2 | 130.0 | 14.3 | 2791 | 29.8 | 45.4 |

| | CARRY m | SIDE m | TOTAL m | HANG TIME s | CLUB PATH deg | FACE ANG. deg |
|---|---|---|---|---|---|---|
| Average | 175.7 | 7.2L | 189.0 | 6.18 | -2.5 | -1.8 |

Prior Art ; Air channel Dimple 332
(Dimple depth 0.168mm, Channel depth 0.05mm with Sharp Edge)

| | CLUB SPEED mph | BALL SPEED mph | LAUNCH ANG. deg | SPIN RATE rpm | HEIGHT m | LAND. ANG. deg | CARRY m | TOTAL m | HANG TIME s |
|---|---|---|---|---|---|---|---|---|---|
| Average | 91.2 | 133.3 | 13.5 | 2718 | 24.6 | 38.7 | 189.0 | 208.1 | 5.97 |

Circular Dimple (T) Dimple 332
(Dimple depth 0.168mm, Dimple Dia. 4.382mm)

| | CLUB SPEED mph | BALL SPEED mph | LAUNCH ANG. deg | SPIN RATE rpm | HEIGHT m | LAND. ANG. deg |
|---|---|---|---|---|---|---|
| Average | 91.0 | 131.9 | 15.9 | 3816 | 28.0 | 38.1 |

| | CARRY m | SIDE m | TOTAL m | HANG TIME s | CLUB PATH deg | FACE ANG. deg |
|---|---|---|---|---|---|---|
| Average | 192.2 | 20.8R | 212.6 | 6.03 | -3.8 | -0.3 |

Air channel Dimple 332
(Dimple depth 0.205mm, Channel depth 0.075mm with Fillet Radius R=0.05mm)

| | CLUB SPEED mph | BALL SPEED mph | LAUNCH ANG. deg | SPIN RATE rpm | HEIGHT m | LAND. ANG. deg |
|---|---|---|---|---|---|---|
| Average | 90.8 | 132.3 | 16.2 | 3869 | 28.8 | 40.5 |

| | CARRY m | SIDE m | TOTAL m | HANG TIME s | CLUB PATH deg | FACE ANG. deg |
|---|---|---|---|---|---|---|
| Average | 188.4 | 18.2R | 206.0 | 6.13 | -3.8 | -0.1 |

3rd channel Dimple 332
(Dimple depth 0.195mm, Channel depth 0.09mm with Fillet Radius R=0.1mm)

| | CLUB SPEED mph | BALL SPEED mph | LAUNCH ANG. deg | SPIN RATE rpm | HEIGHT m | LAND. ANG. deg |
|---|---|---|---|---|---|---|
| Average | 90.9 | 130.9 | 15.7 | 4315 | 27.2 | 37.7 |

| | CARRY m | SIDE m | TOTAL m | HANG TIME s | CLUB PATH deg | FACE ANG. deg |
|---|---|---|---|---|---|---|
| Average | 191.6 | 27.2R | 211.2 | 6.03 | -3.8 | 0.1 |

Circular Dimple (T) Dimple 332
(Dimple depth 0.168mm, Dimple Dia. 4.382mm)

GOLF BALL

CROSS-REFERENCE TO RELATED APPLICATIONS

This application claims the priority of Korean Patent Application No. 10-2018-0094478 filed on Aug. 13, 2018, in the Korean Intellectual Property Office, the disclosure of which is incorporated herein by reference.

BACKGROUND

Field

The present disclosure relates to a golf ball and more particularly, to a golf ball having an air channel between adjacent dimples.

Description of the Related Art

Dimples on the surface of a golf ball are aerodynamically directly involved to have a profound effect on the flight performance of the golf ball. That is, the golf ball causes a reverse rotation according to the loft angle of a golf club at the time of hitting, and at the same time, rebounds by the strong rebound resilience generated from the core of the golf ball. In this case, even if the initial trajectory is similar, the shape of the trajectory and an apex, a flight time, and the like of the trajectory are significantly different according to types or shapes of the dimples or an arrangement of the dimples. Of course, even the same user hits the golf ball using the same golf club, the flight characteristic varies depending on a difference in repulsive power, rigidity and rotational performance of the golf ball, but there are many differences in a duration of flight, a height of the apex, straightness, the influence of wind, and the like according to the shape, size, number, area rate, depth, arrangement method, and the like of the dimples.

In general, circular dimples are used most often as the dimple of the golf ball, and the circular dimples are most widely used because the circular dimples easily make the flow of air constant and can be balancedly arranged throughout the surface of the golf ball. In addition, since mold cavities can be easily manufactured, the circular dimples are applied to many golf balls. However, in such a circular dimple, there is a large difference in flight performance of the golf ball depending on the size thereof. Circular dimples having a small size are difficult to obtain lift force, but the circular dimples are less influenced by wind to provide flight stability to golf balls. On the other hand, a large dimple is easy to obtain lift force, but it is difficult to give the flight stability to the golf balls because of the large influence of the wind, and as a result, the golf ball does not fly to a desired spot, but flies in an unintended direction. The ultimate goal of all golf balls at the time of arranging the dimples is to make golf balls which have good straightness and an increased duration of flight, resulting in good driving distance and flight stability, appropriate spin performance at the time of a short game, and good adjustment force on the field.

As an example of a conventional dimple arrangement method, U.S. Pat. No. 4,560,168 discloses a dimple arrangement method of a golf ball capable of improving flight performance in which when dimples are arranged in a divided structure of spherical icosidodecahedron by dividing the surface of a sphere with 6 great circles, the dimples do not intersect the dividing lines, in this case, in the spherical icosahedron, spherical icosidodecahedron are generated by connecting adjacent the middle points of respective sides of the triangles of the icosahedron.

Further, U.S. Pat. No. 5,957,787 discloses a dimple arrangement method in which the largest circular dimples are arranged at the center of each spherical triangle by dividing the surface of a sphere into spherical icosahedrons and annular dimples having the same center as the circular dimples are arranged outside the circular dimples, thereby lowering a drag coefficient in a low-speed area, and when the annular dimples are present in a direction perpendicular to the direction of the air flow, the rotation is maintained longer to provide flight stability, thereby increasing the flight distance. However, in the case of the dimple arrangement method, the air flow inside the annular dimple becomes strong due to the annular uneven surface having one large continuous depth, and the initial trajectory tends to be lowered too much, that is difficult to improve the flight distance by the proper trajectory.

Further, U.S. Pat. No. 6,709,349 discloses a dimple arrangement method in which when arranging dimples on the surface of a golf ball, various types of radial arms radially recessed or protruding from the center of the dimple or near the center of the dimple are formed, or radial arms having uniform shapes from a hub to an edge are formed at the center of the dimple, and various types of sub-dimples are installed in the edge of the dimple or inside the dimple to stir the flow of air, thereby increasing a flight distance due to rapid energizing. However, in the case of the dimple arrangement method, since one dimple is divided into equal parts from the center of the dimple, the whole inside of one dimple receives the same pressure anywhere so as not to help in rotational force, and the pressure drag and the friction drag of the golf ball are increased, so that the flight distance may be reduced due to a sudden change in the trajectory at the time of flight.

Further, U.S. Pub. No. 2012/0,302,377 A1 discloses a dimple arrangement method in which elliptical or non-circular dimples are arranged on the surface of a golf ball having a spherical polyhedron, in which the length of a main axis making one pair is 1.2 times or more as long as the length of a short axis and the long axis is constituted by a pair of circular arcs, and a turbulent transition is promoted at the edges of the dimples of a pair of long arcs to further reduce the width of the separation band as compared with the width of the separation band at the boundary layer formed by general circular dimples, thereby increasing a flight distance by reducing the drag during flight of the golf ball. However, since the dimple of such an arrangement has a large difference between the long axis and the short axis, if the same portion of the golf ball is not repeatedly hit at the time of hitting, there is a difference in that each flight direction is not constant when the long axis is hit or the short axis is hit, and there is a possibility that there is a problem in flight stability.

Meanwhile, U.S. Pat. No. 5,879,245 discloses a dimple arrangement method having a unique concept in which it is possible to reduce the independence of each of the dimples by forming air connection channels, that is, air channels between the dimples formed on the surface of the sphere divided into spherical polyhedrons. According to the dimple arrangement method having air channels according to U.S. Pat. No. 5,879,245, there is disclosed that it is possible to increase flight stability and a flight distance by minimizing the drag generated during flight of the golf ball by giving continuity to the air flow. However, in the case of the air channel disclosed in U.S. Pat. No. 5,879,245, unintended problems are accompanied due to a sharp edge structure of the outer tip.

For example, the sharp irregularities due to the outer tip of the air channel disclosed in U.S. Pat. No. 5,879,245 may be easily damaged at the time of hitting by a golf club such as a short iron or a wedge, so that the durability is degraded. Also, there are problems in that a slice occurs due to excessive influence of air at the time of hitting by a driver, a flight distance is decreased because a high peak of the trajectory is rapidly reached at a short flight distance, or straightness is rapidly deteriorated by the influence of wind in the upper atmosphere due to excessively high trajectory. As a result, there is a limitation that the intended effect is not sufficiently implemented through the formation of the air connection passage.

SUMMARY

An object of the present disclosure is to improve U.S. Pat. No. 5,879,245 and to provide a golf ball with improved flight stability related with slice prevention, straightness, and excellent landing point while solving a problem of deterioration of durability at an outer tip of an air channel over the surface of the golf ball, minimizing the influence of wind at the outer tip of the air channel, and ensuring a sufficient flight distance by uniformalizing pressure drag, in a golf ball with air channels formed to increase flight stability and a flight distance by minimizing the drag generated during flight of the golf ball by giving continuity to the air flow.

The present inventors contrived a method in which in the process of researching and developing a golf ball related to the above-mentioned problem, in order to minimize the influence of air in a golf ball with air channels connecting adjacent dimples, an outer tip of the air channel is chamfered or filleted so as to alleviate a vortex generated by a rapid change in air flow in a conventional air channel having an outer tip of a sharp edge shape. Meanwhile, a phenomenon in which the depth of the air channel is increased and the depth of the dimple itself is relatively decreased by the chamfer or fillet, and thus lift force is reduced is focused, and as a means for offsetting the phenomenon, the inventors reached this present disclosure by contriving a method in which the depth of the dimple itself is formed larger than the dimple depth of a conventional golf ball with air channels. The gist of the present disclosure based on the perception and knowledge of the above-mentioned problems is as follows.

(1) A golf ball includes air channels connecting adjacent dimples, in which an outer tip of the air channel is chamfered or filleted.

(2) In the golf ball of (1), the fillet radius may be greater than 0 and less than 0.1 mm.

(3) In the golf ball of (1), the width of the air channel may be 5 to 20% of the dimple diameter.

(4) In the golf ball of (1), the diameter of the dimple may be 2.54 mm or more and the width of the air channel may be 0.1 mm to 1.2 mm.

(5) In the golf ball of (1), the depth of the air channel may be 5 to 50% of the dimple depth.

(6) In the golf ball of (1), the depth of the dimple may be 0.18 to 0.25 mm and the depth of the air channel may be 0.01 mm to 0.125 mm.

(7) In the golf ball of (1), the bottom surface of the air channel may have a planar, triangular or curved cross-sectional profile.

(8) In the golf ball of (1), the air channels may be included in all of the dimples.

(9) In the golf ball of (1), the air channels may be included in some of the dimples.

(10) In the golf ball of (1), an area rate of the dimples having the air channels may be 79% or more based on the entire surface area.

(11) In the golf ball of (1), the depth of the dimple may be 20 to 50% deeper than the depth of the dimple when the outer tip of the air channel is not chamfered or filleted.

As described above, according to the present disclosure, the problem of durability deterioration at the outer tip of the air channel over the entire surface of the golf ball is solved by the air channel structure in which the outer tip is chamfered or filleted. Meanwhile, it is possible to minimize the influence of wind at the outer tip of the air channel and greatly improve flight stability related with slice prevention, straightness, and excellent landing point while ensuring a sufficient flight distance by uniformalizing pressure drag. In addition, the depth of the dimple itself is selectively made larger than the depth of the dimple of the conventional golf ball with the air channel in accordance with the chamfering or filleting of the outer tip of the air channel, thereby minimizing lift force and a loss of a flight distance.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Figure 1:
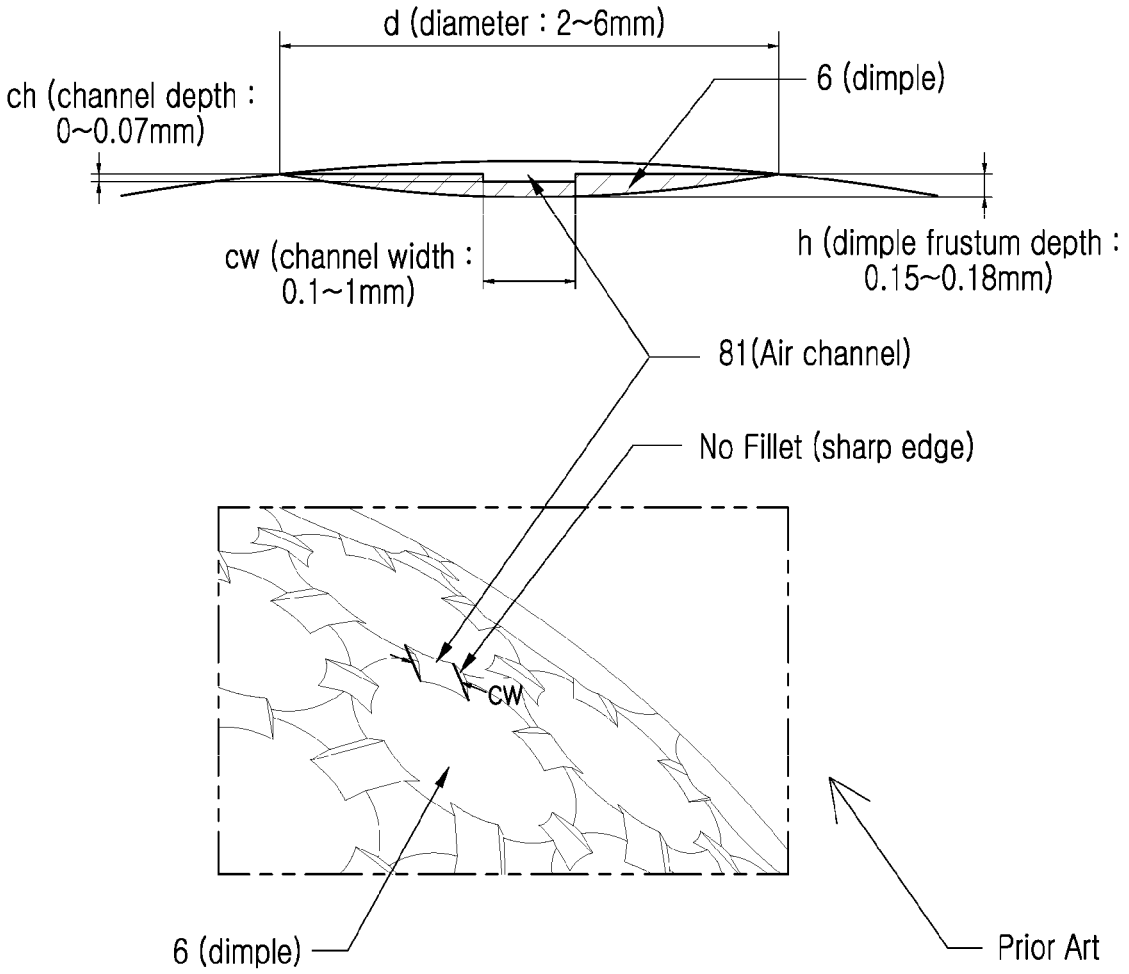
FIG. 1 is a diagram illustrating a surface and a cross-sectional profile of a golf ball with an air channel according to the prior art.

Hereinafter, the present disclosure will be described in detail with reference to the accompanying drawings so that those skilled in the art can easily carry out the present disclosure. However, the present disclosure may be embodied in many different forms and is not limited to embodiments described herein. In order to clearly explain the present disclosure in the drawings, parts not related to the description are omitted.

Generally, the reason why the dimples are formed on the surface of the golf ball is that the role of dimples is aerodynamically important. The golf ball which turns reverse and flies to a target point, due to the dimples, air slowly flows from the bottom and the air pressure increases, but the air flows very fast at the top and the pressure decreases, and thus the golf ball flies by lift force formed by Bernoulli's principle. At this time, both the pressure drag and the friction drag increase. It is well known that the circular dimples are mostly used as dimples of golf balls up to the present. Regarding a method of arranging circular dimples on a spherical surface, first, a spherical polyhedron having a plurality of spherical polygons as surface elements is formed by dividing a spherical surface by the great circles, and then the circular dimples are arranged symmetrically on the surface. Of course, in addition to the circular dimples, dimples having various shapes such as ellipses, spherical hexagons, and spherical triangles are also used, but since the circular dimples induce the flow of air symmetrically, it is advantageous for straight flight and a rapid change in path is small due to the influence of wind, and as a result, the circular dimples have been adopted in the most golf balls. However, as described above, when the size of the circular dimple is large, it is easy to obtain lift force, but the flight stability is bad due to the influence of the wind during the flight. On the other hand, when the dimple size is small, the flight stability is good, but it is difficult to obtain the lift force and the flight distance is relatively short. In addition, in the case of a golf ball with many dimples having a large diameter, in addition to reducing the flight distance by the drag generated from the rear side of the flight direction, there is a drag on both sides forming a rotation axis during flight. Accordingly, if the golf ball is not correctly hit, that is, missed, the farther the distance is, the farther away from the desired point falls, and thus the landing point is formed or the trajectory is strongly influenced by the wind and shaken.

Like U.S. Pat. No. 5,879,245 in the prior art, in order to improve the drawbacks of such a circular dimple, the present disclosure is basically characterized by providing air channels between adjacent dimples to increase flight stability and flight distance by minimizing drag during flight of a golf ball by providing continuity to air flow. In this case, these air channels may be formed on all or some of the dimples, and when the air channels are formed on some of the dimples, it is preferable that the area rate of the dimples provided with the air channels is designed to be 79% or more based on the total surface area so as to be sufficient to implement the effect by the air channels.

Figure 2:
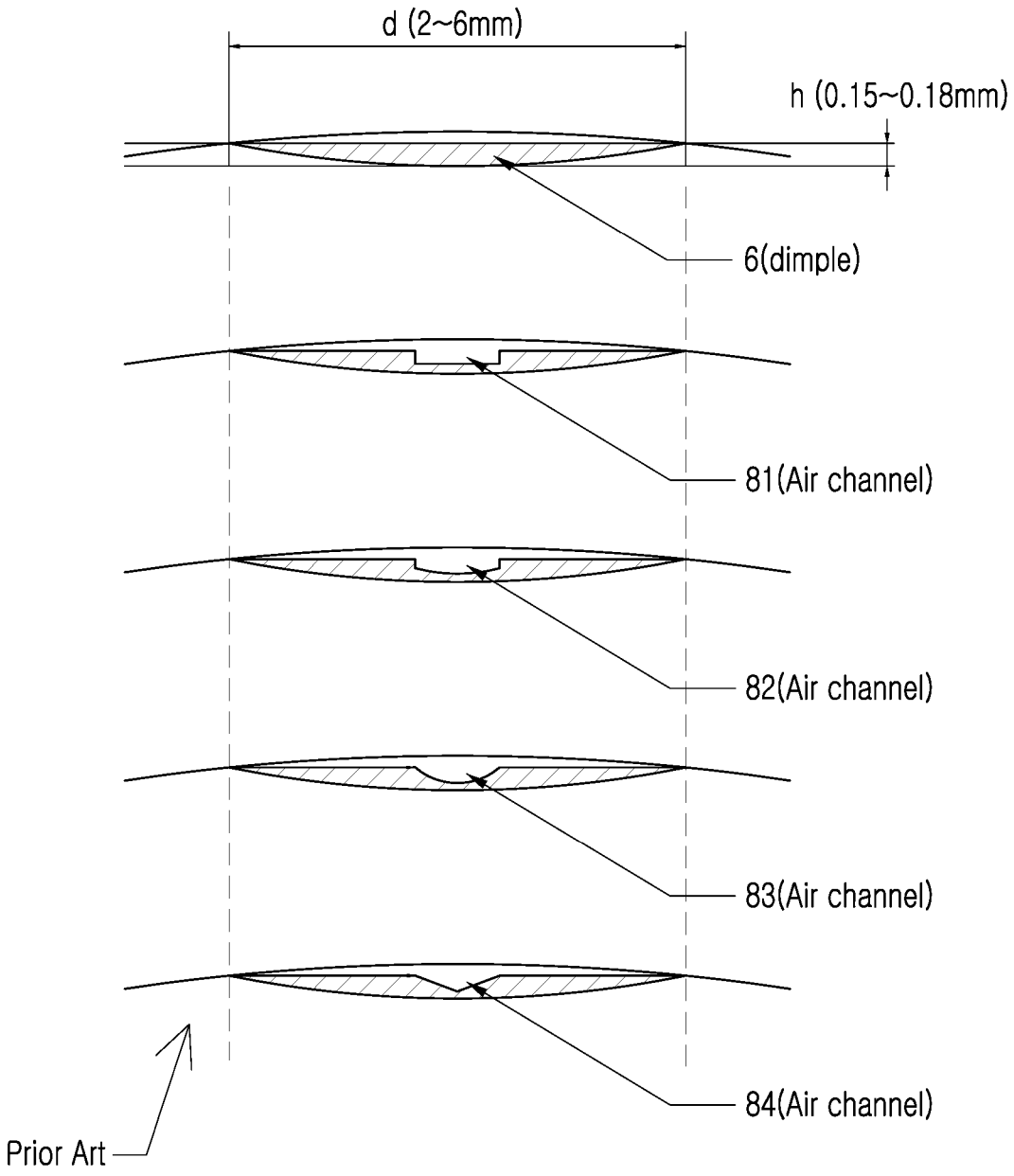
FIG. 2 is a diagram illustrating a cross-sectional profile of a golf ball with an air channel having various cross-sectional shapes according to the prior art.

On the other hand, the air channel can solve the disadvantage of the golf ball with simple circular dimples. However, U.S. Pat. No. 5,879,245 discloses an air channel which has a problem that durability is lowered at the time of hitting by a short iron or a wedge due to an outer sharp tip shape of the air channel as described above, and has another problem that slices are generated due to excessive air influences during flight, or the flight distance is lost due to rapid trajectory increased at a short distance and flight stability is deteriorated due to the influence of the wind. FIGS. 1 and 2 are diagrams of a conventional air channel such as U.S. Pat. No. 5,879,245. FIG. 1 illustrates a surface and a cross-sectional profile of the golf ball and illustrates a part of the surface of a golf ball with air channels having a sharp outer tip shape between the adjacent dimples. Also, as illustrated in FIG. 1, in the case of the conventional golf ball, a depth ch of the air channel and a depth h of the dimple are designed to be numerically low, which is one of differences from the present disclosure as described below. FIG. 2 illustrates a cross-sectional profile for air channels having various shapes in the prior art. FIG. 2 illustrates various cross-sectional shapes of the air channel having a sharp outer tip in the prior art and illustrates that the depth ch of the air channel and the depth h of the dimple are designed to be numerically low like FIG. 1.

In order to improve the problem of the air channel in the prior art, the present disclosure is further characterized in that the air channels are included and an outer tip thereof is softly chamfered or filleted. A sharp edge of the outer tip of the air channel is smoothly softened by chambering or filleting so that a phenomenon in which the air flow is distributed or the vortex is generated in the vicinity of the outer tip during the flight of the golf ball is significantly improved, thereby eventually minimizing excessive air influence at the outer tip of the air channel. In addition, since the protruding degree of the chamfered or filleted outer tip is smaller than that of the outer tip having the sharp edge, the possibility of damage to the outer tip and durability deterioration due to the hitting by the golf club may be effectively prevented.

On the other hand, when the outer tip of the air channel is chamfered or filleted, the depth ch of the air channel is deeper due to the metal machining at the time of manufacturing of the mold cavity, and accordingly, the depth h of the dimple related to the lift force is lower than an actual design value. Accordingly, the present disclosure is further characterized in that by the reduction in lift force due to chamfering or filleting, the depth h of the dimple is increased compared to a dimple with the sharp air channel in the prior art. In this case, it is preferable that the depth h of the dimple with the air channel of which the outer tip is chamfered or filleted according to the present disclosure is 20 to 50% deeper than that of the dimple in the prior art. If the depth h is less than 20%, an effect of lift force increase is not sufficient, and if the depth h exceeds 50%, it is too deep and it is not preferable because there is actually a problem in cavity production.

Figure 3:
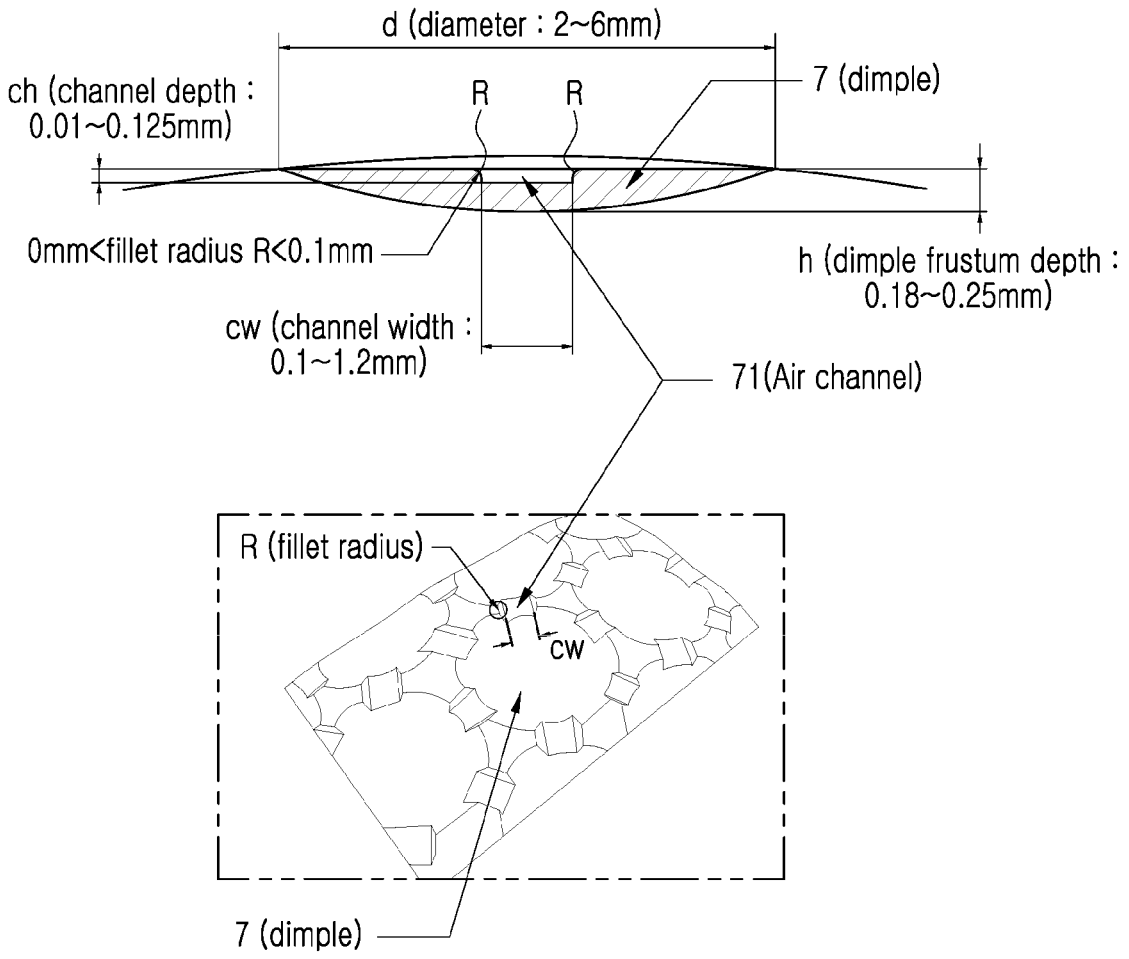
FIG. 3 is a diagram illustrating a surface and a cross-sectional profile of a golf ball with an air channel according to an embodiment of the present disclosure.
Figure 4:
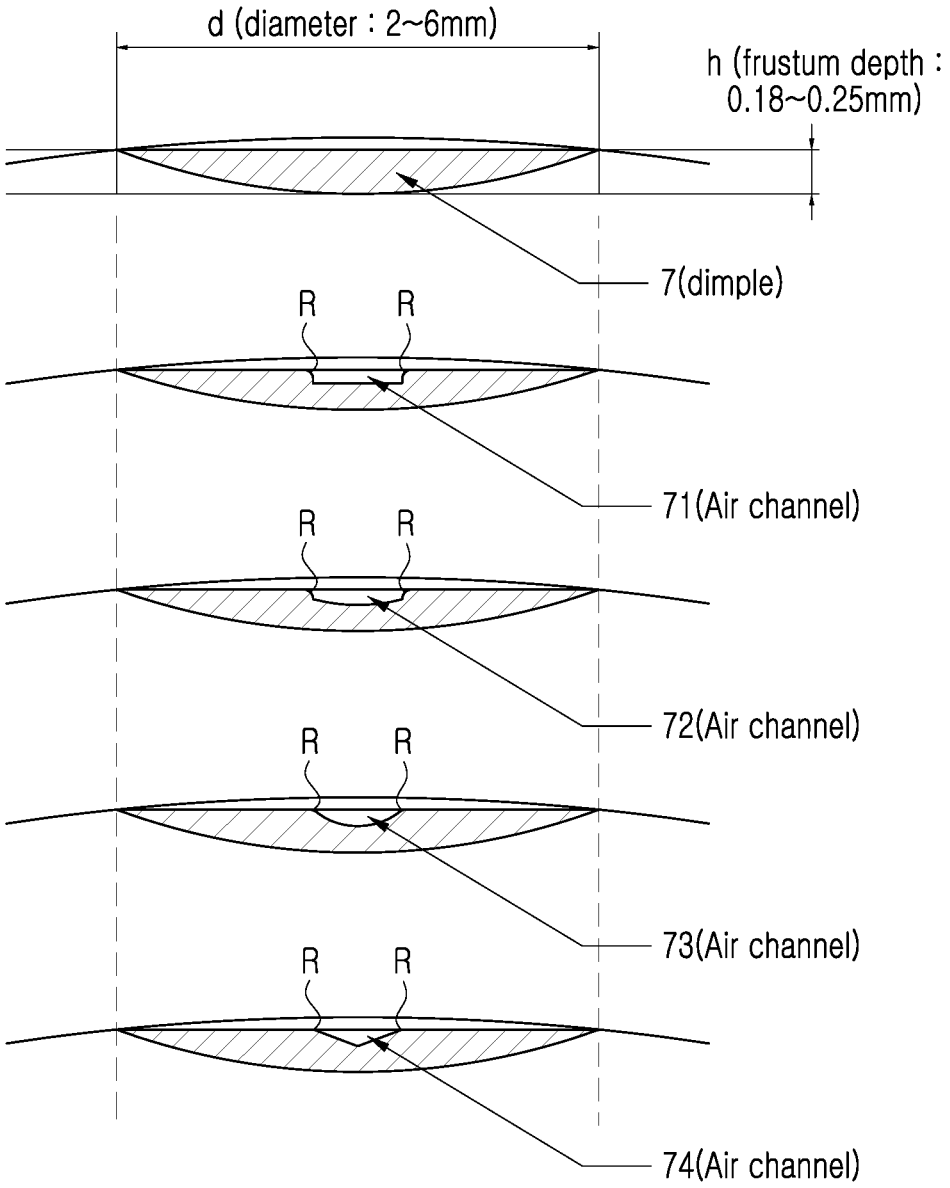
FIG. 4 is a diagram illustrating a cross-sectional profile of a golf ball with an air channel having various cross-sectional shapes according to the embodiment of the present disclosure.

Particularly, FIGS. 3 and 4 are diagrams of the embodiment of the present disclosure. First, FIG. 3 illustrates the surface and the cross-sectional profile of the golf ball with the air channels and is similar to FIG. 1 for comparison with the prior art. FIG. 3 is an example illustrating a portion of the surface of the golf ball in which dimples with air channels having improved performance are arranged according to the present disclosure, which illustrates details designed such that the depth ch of the air channel is deeper than that of the air channel in the prior art, and the outer tip is softly chamfered or filleted unlike the sharp edge shape in the prior art and has an actual fillet radius R. In addition, FIG. 3 numerically illustrates that the depth h of the dimple is much deeper than that of the conventional dimple of FIG. 1 by a relative depth loss as the air channel is deepened, and illustrates an enlarged part of the actual surface of the golf ball with improved performance by changing the design. Next, FIG. 4 illustrates a cross-sectional profile of the golf ball with air channels having various cross-sectional shapes and is similar to FIG. 2 for comparison with the prior art. FIG. 4 illustrates various cross-sectional shapes of the air channels having an outer tip processed to have a chamfer or fillet radius R, in which the depth ch of the air channel and the depth h of the dimple are numerically designed to be larger than those of FIG. 2 in the prior art like FIG. 3.

The soft chamfer or the round fillet is also related to the depth ch of the air channel as described below, and plays a very important roll in solving the aforementioned many problems generated at the sharp tip of the conventional air channel and improving flight performance of the dimple by reinforcing the function of the air channel. That is, as one of the disadvantages of the conventional air channel, when the ball is hit by a wedge or a short iron, the sharp tip is easily damaged, and when the ball is hit by a driver, while the ball rotates and files, trajectory early reaches the highest peak which is higher than a general golf ball due to rapid vortex to be influenced by the wind very much, and thus, the problem is improved by the soft chamfer or the round fillet. In this case, when soft chamfering or fillet machining, the fillet radius R is preferably greater than 0 and less than 0.1 mm. If the fillet radius R is greater than 0.1 mm, the fillet radius R is occupied by 0.1 mm or more toward both sides of the channel, resulting in a loss of lift force due to the size thereof and a loss in distance. Therefore, it is preferable that the fillet radius is determined according to depth ch of the air channel to be described below, and the depth ch of the air channel may be determined based on the depth h of the dimple as described below.

A width cw of the air channel is preferably 5 to 20% of the dimple diameter. If the dimple diameter is less than 5% of the dimple diameter, the effect of forming the air channel is insignificant, and if the dimple diameter is too large and more than 20%, it is not preferable that the air pressure is too easily removed to make it difficult to obtain the required lift force. Meanwhile, when considering the diameter of the general circular dimples, the width cw of the air channel is preferably in the range of 0.1 mm to 1.2 mm, and in this case, if the dimple diameter is too small, it is difficult to form an air channel and thus a minimum size of the dimple diameter needs to be 2.54 mm or more. This is because the depth h of the dimple diameter d is limited on the limit of the machining of the metal mold for manufacturing the golf ball. Accordingly, when the chamfer or fillet radius R is considered at the time of forming the air channel according to the present disclosure, it is difficult to have the width cw described above and the depth ch to be described below.

Also, the depth ch of the air channel according to the present disclosure is determined in relation to the depth h (referred to as a frustum depth) of the corresponding dimple, and the depth ch of the air channel is one of the most important parts in the present disclosure. The conventional air channel has a dimple depth h similar to the depth of the circular dimples by applying general circular dimples, and the air channel is designed herein, and in fact, the relation between the depth ch of the air channel and the depth h of the dimple is not importantly considered. As a result, in the case of the air channel according to the present disclosure, since the outer tip is processed with the soft chamber or round fillet radius R, it is required to make the air channel deeper than the conventional air channel. In this case, when the air channel having the increased depth ch according to the present disclosure is applied to the general circular dimple, the depth h of the corresponding circular dimples is relatively lowered and as a result, the lift force is aerodynamically lowered and only the drag by the shape is increased, and thus the flight distance is significantly decreased and the trajectory rapidly reaches a maximum point at a short distance after hitting to be influenced by the wind very much, so that a landing angle is disturbed and it is difficult to obtain the constant and uniform landing point.

From this point of view, the depth ch of the air channel is preferably set to 5% to 50% of the depth h of the dimple. If the depth ch of the air channel is less than 5% of the depth h of the dimple, the dimple is virtually too thin so that the role of the air channel is meaningless and there is no difference from a general circular dimple. On the contrary, when the depth ch of the air channel is more than 50% of the depth h of the dimple, there is a problem in lift force and a reduction in the flight distance is remarkable. Accordingly, for example, if the depth h of the corresponding dimple is 0.18 mm to 0.25 mm, the depth ch of the corresponding air channel is 0.01 mm to 0.125 mm, and when the dimple depth h is low, the depth ch of the air channel should be relatively lowered so that there is no difficulty in performing its original role.

The soft chamfer or the round fillet associated with the depth ch of the air channel plays a very important roll in solving many aforementioned problems generated at the sharp tip of the conventional air channel and improving flight performance of the dimple by reinforcing the function of the air channel. As one of the disadvantages of the conventional air channel, when the ball is hit by a wedge or a short iron, the sharp tip is easily damaged, and when the ball is hit by a driver, while the ball rotates and files, trajectory early reaches the highest peak which is higher than a general golf ball due to rapid vortex to be influenced by the wind very much. According to the present disclosure, the radius R of the fillet tip is considered as a radius R having a rounded shape close to a circle, and the outer tip is an outer tip of an air channel 71 having 0 mm<Fillet Radius R<0.1 mm according to the present disclosure. If the fillet radius R is greater than 0.1 mm, the fillet radius R is occupied by 0.1 mm or more each toward both sides of the channel, resulting in a loss of lift force due to the size thereof and a loss in distance. Accordingly, as described above, it is preferable that the fillet radius R is determined according to the channel depth ch, and it is preferable to determine the fillet radius R based on the depth h of the dimple.

The bottom surface of the air channel may have a planar, triangular, or curved cross-sectional profile.

Evaluation of Performance

As described above, a new air channel according to the present disclosure is changed into three types and eight golf balls having a surface with dimples of each kind of air channel were hit by 90 MPH by installing a driver to a Servo Swing Robot of Golf Laboratories, Inc. (USA). The performance (average values of initial velocity, launch angle, rotation amount, flying apex height, landing angle, flight distance, flight time, etc.) after hitting of the golf balls with the air channels according to the present disclosure and the trajectory obtained by tracking the flight trajectory and the landing point by the radar and camera were shown by Trackman from Trackman A/S (Denmark) Co., Ltd. (hitting and flight analysis equipment with dual radar and camera). 8 golf balls having the surface with dimples having air channels in the prior art were compared with general golf balls with circular dimples having the same dimple arrangement (332 dimples: quasi-truncated icosahedron) as the golf ball having the surface with dimples having the air channels, and results thereof were illustrated in FIGS. 5 to 12.

Figure 5:
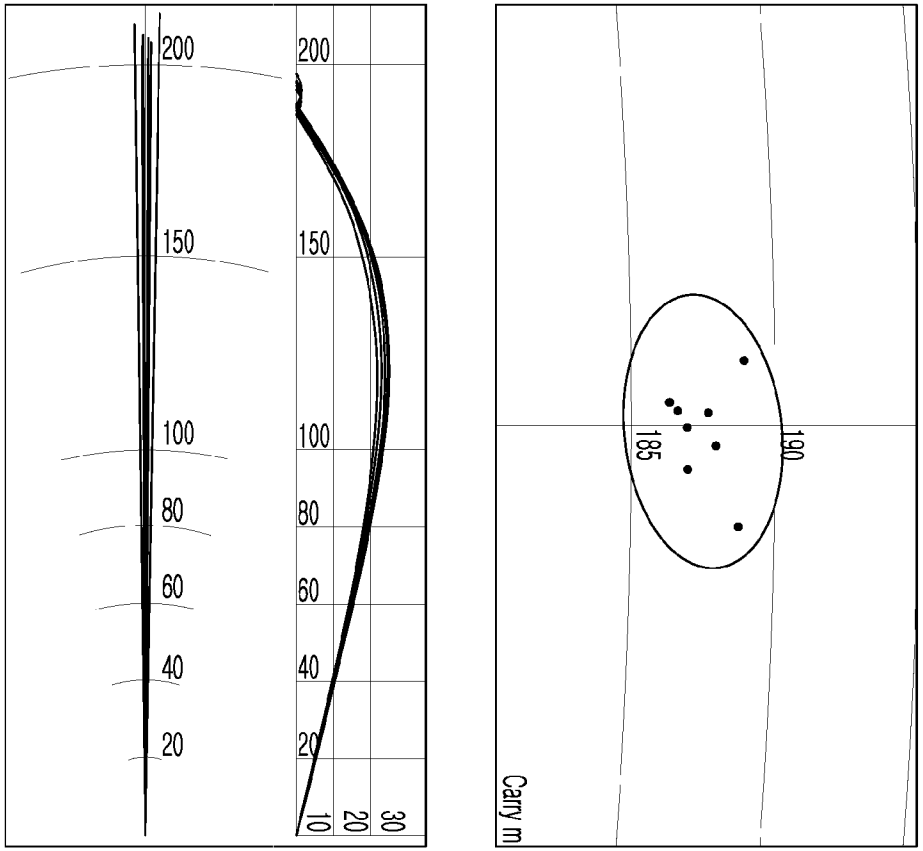
FIGS. 5 to 7 are photographs showing experiments on flight performance of a golf ball having an air channel according to the embodiment of the present disclosure.

First, FIG. 5 shows performance (average values of initial velocity, launch angle, rotation amount, flying apex height, landing angle, flight distance, flight time, etc.) after hitting of 8 golf balls arranged with dimples having air channels with improved performance made by the present disclosure and the trajectory obtained by tracking the flight trajectory and the landing point by the radar and camera. As a result, compared with other golf balls, the improved performance such as the precise landing point and stable flight trajectory, can be clearly seen. In this case, the depths h of the dimples are large enough to deepen the air channel, and have an appropriate fillet R radius.

Figure 6:
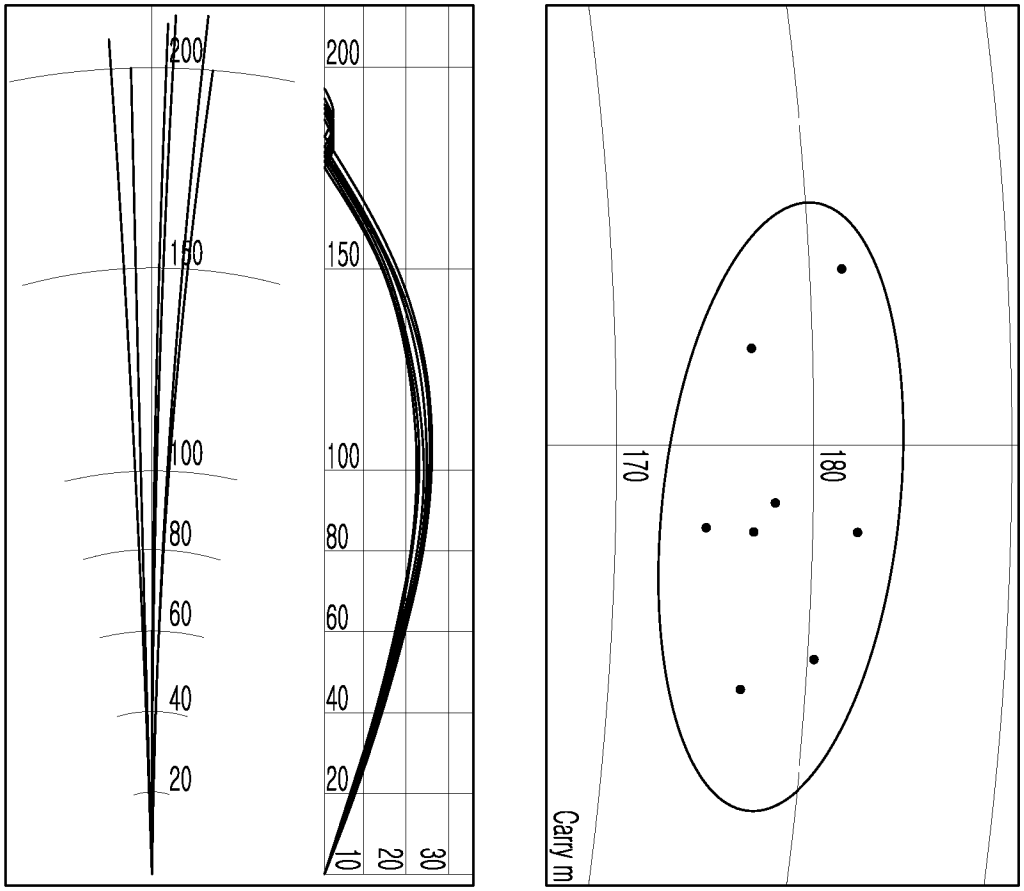

FIG. 6 illustrates a result of analyzing the landing point and the flight trajectory of eight golf balls in one process for finding the optimum point of the present disclosure in the same manner as in FIG. 5, and it can be seen that the flight distance is lowered, the landing point is not accurate, and the straightness is decreased as compared with FIG. 5. In the golf ball of FIG. 6, the depth h of the dimple is similar to that of the dimple with the conventional air channel, and the outer tip of the filleted air channel has a radius R larger than the dimple depth h.

Figure 7:
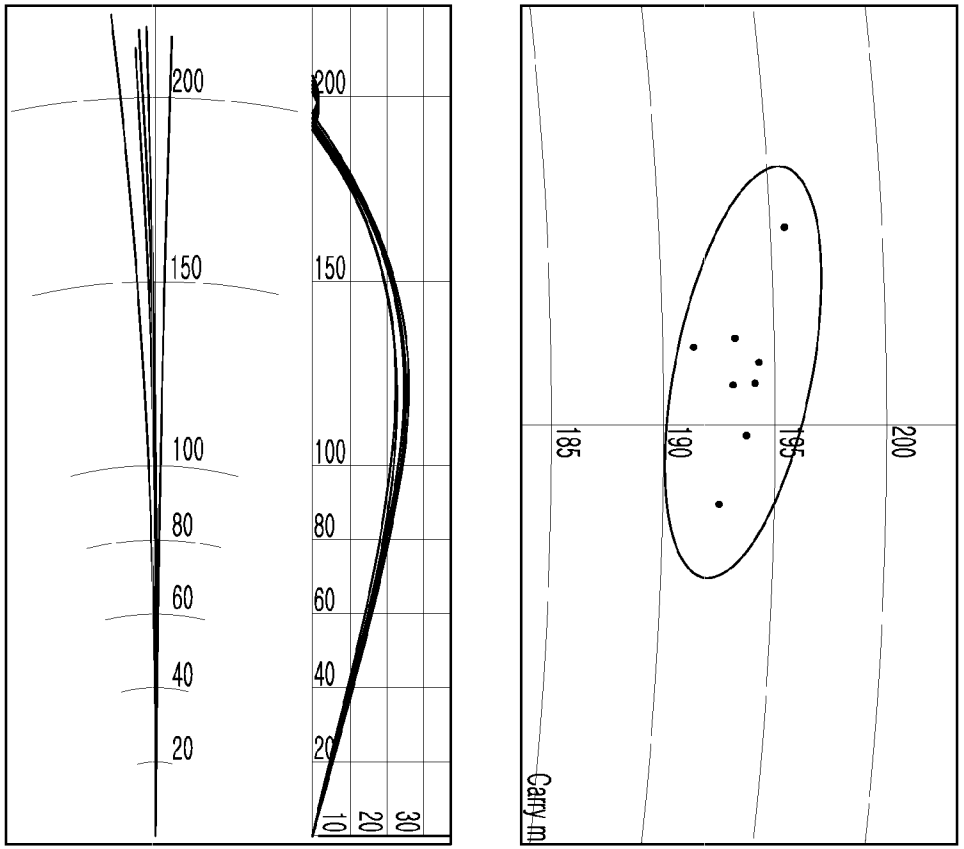

FIG. 7 illustrates a result of analyzing the landing point and the flight trajectory of eight golf balls manufactured by modifying the golf balls of FIG. 6 in the same manner as in FIG. 5, and as a result, it is shown that the flight distance is increased, the landing point is better, and the trajectory of flight trajectory is even better as compared with FIG. 6. In the golf ball of FIG. 7, the depth h of the dimple is deeper by a deepened degree of the air channel, and the outer tip of the air channel is filleted with the same radius R as FIG. 6.

Figure 8:
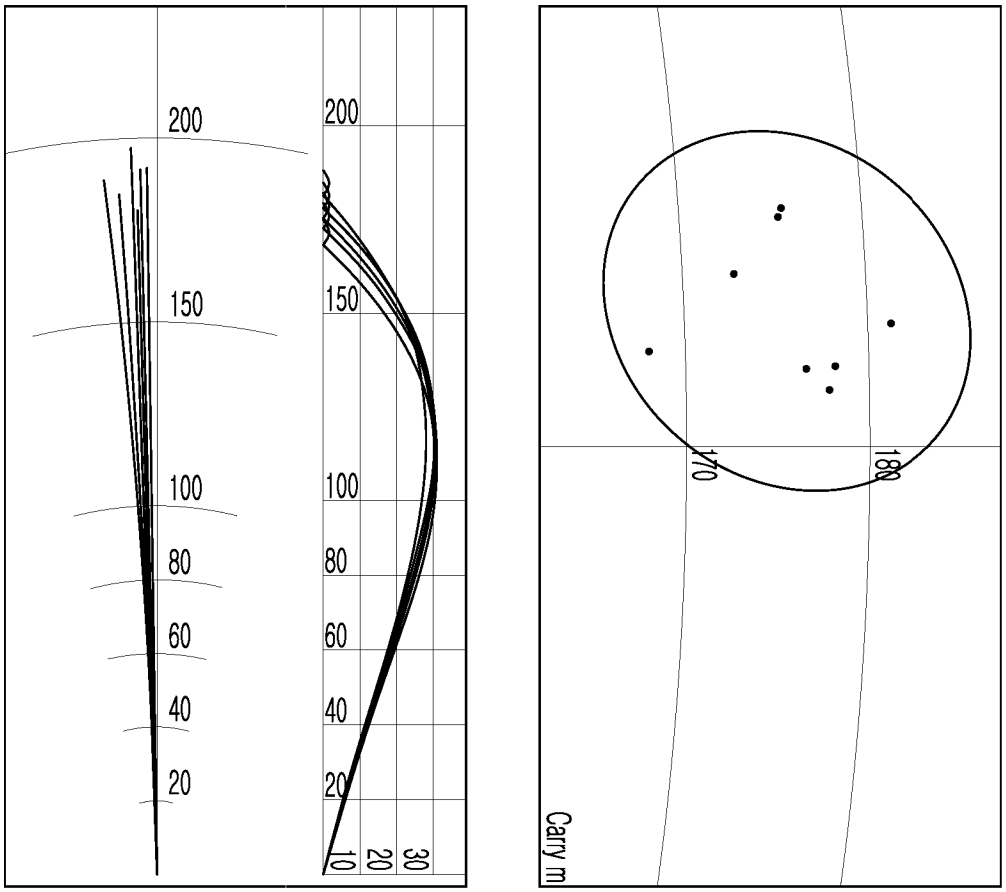
FIG. 8 is a photograph showing an experiment on flight performance of a golf ball having an air channel according to the prior art.

FIG. 8 illustrates a result of analyzing the landing point and the flight trajectory of eight golf balls having the conventional air channels illustrated in FIG. 1 in the same manner as in FIG. 5, and it can be seen that an excessively high flight peak after hitting is formed, and thus the flight distance is reduced, and the landing point is also pushed to the left by the influence of wind due to a high point. In the golf ball of FIG. 8, the depth h of the dimple is shallow, the depth of the air channel is also shallow and the golf ball has a sharp outer tip.

Figure 9:
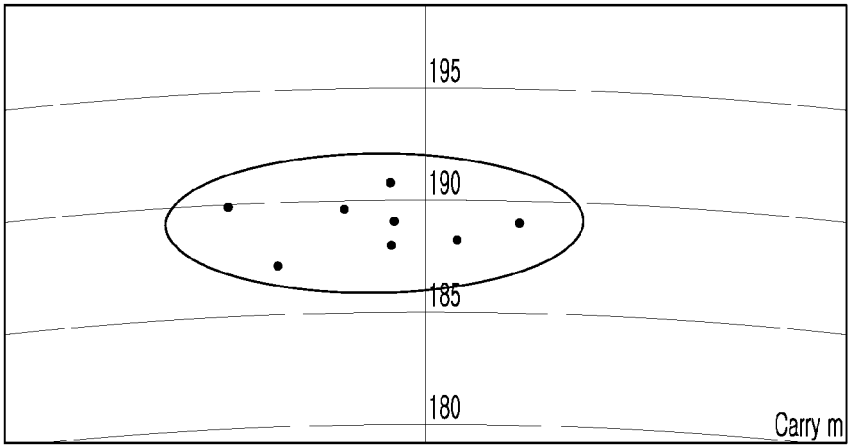
FIG. 9 is a photograph showing an experiment on flight performance of a golf ball without an air channel according to the prior art.
Figure 9:
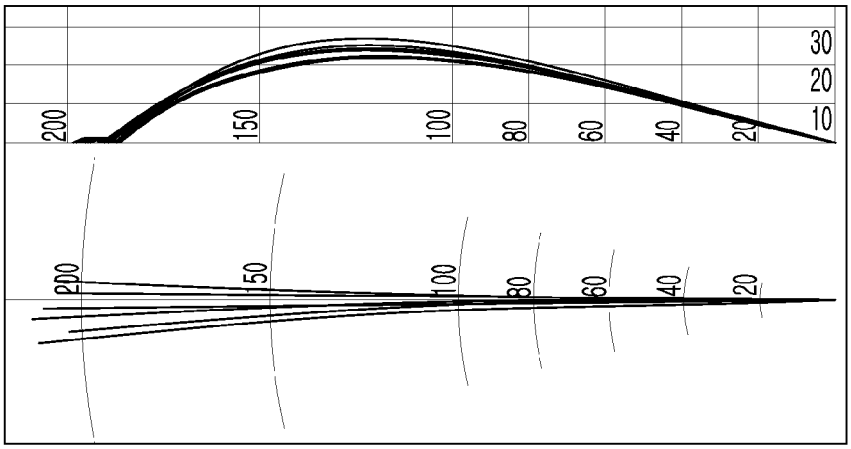

FIG. 9 illustrates a result of analyzing the landing point and the flight trajectory in the same manner as in FIG. 5 in order to compare dimples having air channels with dimples which have the same arrangement of dimples as a golf ball shown in another drawing without an air channel as a golf ball in which general circular dimples without an air channel are arranged on a surface of a sphere in the prior art, and is to determine roles and functions of the air channel. FIG. 9 illustrates that the landing point is disturbed. In the golf ball illustrated in FIG. 9, the dimple depth h is the same as that in FIG. 6.

Figure 10:
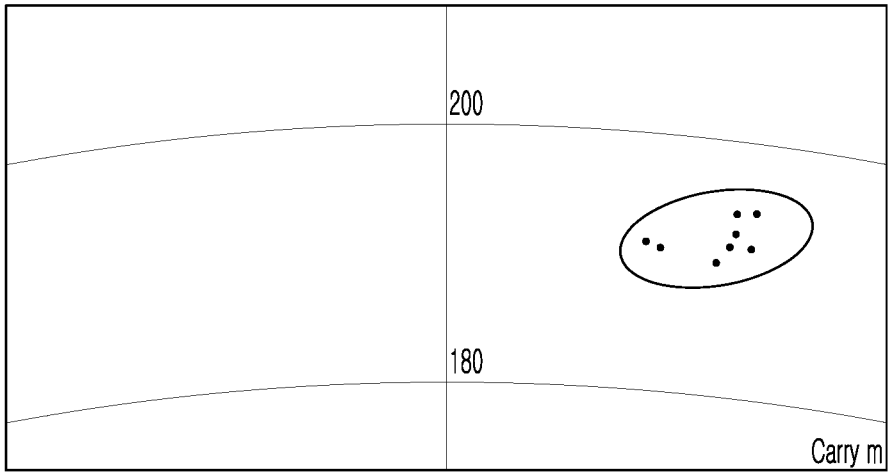
FIGS. 10 and 11 are photographs showing experiments on flight performance of a golf ball having an air channel at the time of slice hitting according to the embodiment of the present disclosure.
Figure 10:
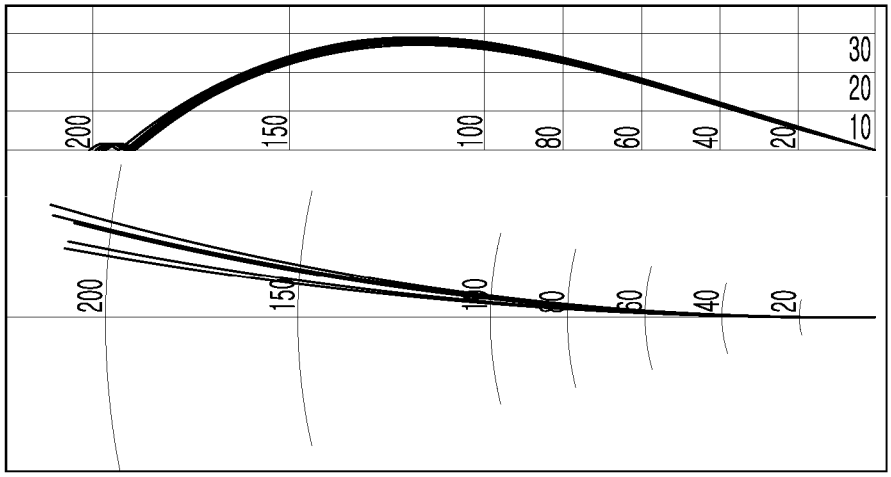

FIG. 10 is to determine a role of decreasing that when the club does not hit the golf ball with exactness and the club hits a so-called slice hitting in from out to in, the landing point is gradually far away as the golf ball is far away from a flight start point as one object of improving the dimple of the air channel. FIG. 10 illustrates the performance (average values of initial velocity, launch angle, rotation amount, flying apex height, landing angle, flight distance, flight time, etc.) after hitting of the golf balls and the trajectory obtained by tracking the flight trajectory and the landing point by the radar and camera, by fitting a club face angle of a driver to 0 degree with the same equipment as FIG. 5, passing through a club passage path from 4° out to in to perform slice-hitting with 90 MPH, and hitting a golf ball having a surface with dimples having air channels of the present disclosure. As compared with other golf balls, it can be seen that the slice is much alleviated, and the landing point is closest to the center straight line, and the side deviated from the center line is small and a fixed landing point is formed.

Figure 11:
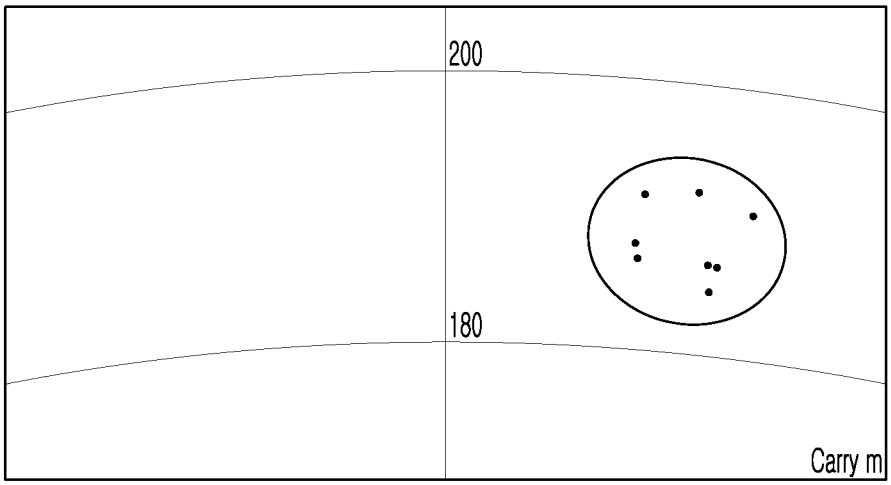
Figure 11:
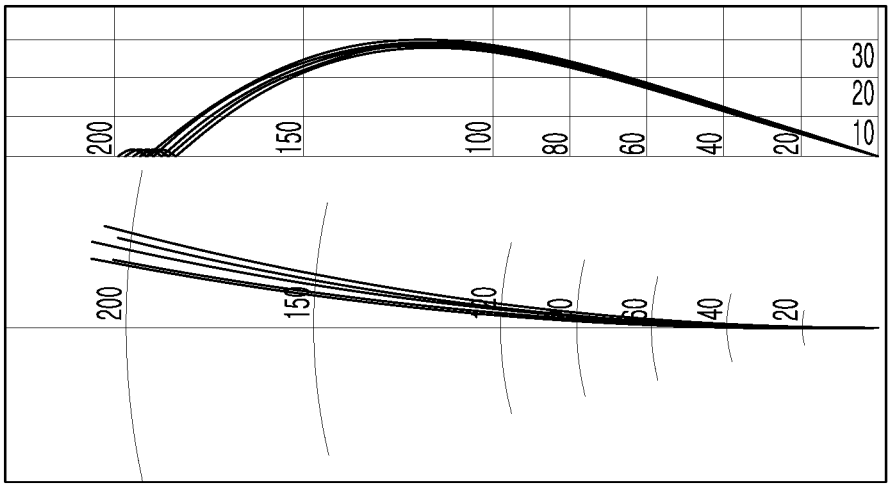

FIG. 11 illustrates a result of analyzing the performance with Trackman by fitting a club face angle of a driver to 0 degree with the same equipment in the same manner as FIG. 10 and passing through a club passage path from 4° out to in to perform slice-hitting with 90 MPH in a golf ball having air channel dimples in FIG. 7, and it can be seen that the landing point is similar to that of FIG. 10.

Figure 12:
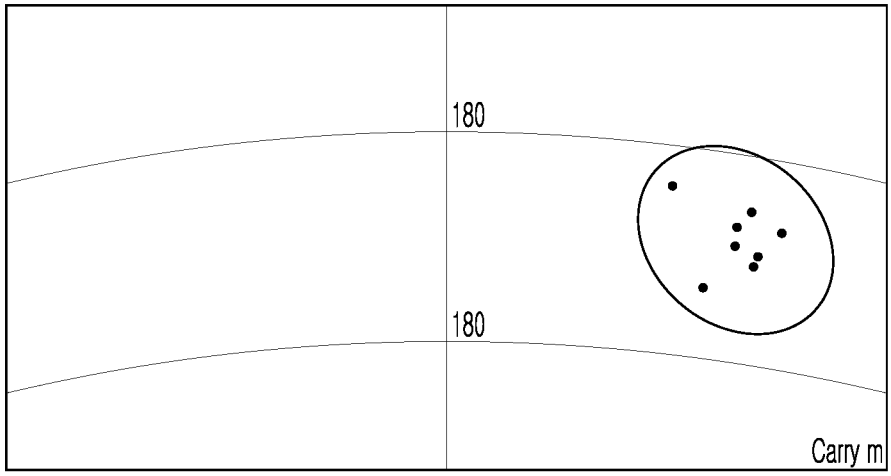
FIG. 12 is a photograph showing an experiment on flight performance of a golf ball without an air channel at the time of slice hitting according to the prior art.
Figure 12:
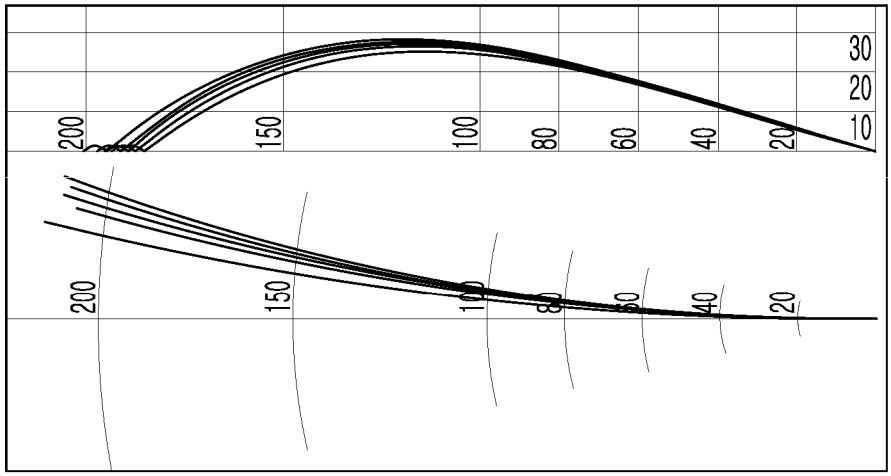

FIG. 12 illustrates a result of analyzing the performance with Trackman by fitting a club face angle of a driver to 0 degree with the same equipment in the same manner as FIG. 10 and passing through a club passage path from 4° out to in to perform slice-hitting with 90 MPH in a golf ball having a spherical surface with the same circular dimples in FIG. 9 without an air channel, and it is shown that there is a large deviation from a reference center line of a golf ball with general circular dimples without an air channel like the present disclosure.

Meanwhile, it is shown that as the shape of the landing point of 8 golf balls represented by a circle in FIGS. 5 to 12 is shown as a small circle, the accuracy is higher.

The results of the comparison according to FIGS. 5 to 12 and the specifications of the golf balls according to the present disclosure and the prior art used in each of FIGS. 5 to 12 are summarized in the following Tables 1 and 2.

TABLE 1

| Result Drawing | Dimple Dia mm | Air Channel Width mm | Dimple Depth mm | Air Channel Depth mm | Fillet Radius mm |
|---|---|---|---|---|---|
| FIG. 5 | 4.382 | 0.8 | 0.205 | 0.075 | 0.05 |
| FIG. 6 | 4.382 | 0.92 | 0.168 | 0.05 | 0.1 |
| FIG. 7 | 4.382 | 0.92 | 0.195 | 0.09 | 0.1 |
| FIG. 8 (Prior Art) | 4.382 | 0.92 | 0.168 | 0.05 | No Fillet |
| FIG. 9 Circular D. | 4.382 | — | 0.168 | — | — |

* Hitting condition: Face Angle 0 deg., Club Path 0 deg. (Head speed 90 MPH)

TABLE 2

| Result Drawing | Dimple Dia mm | Air Channel Width mm | Dimple Depth mm | Air Channel Depth mm | Fillet Radius mm |
|---|---|---|---|---|---|
| FIG. 10 | 4.382 | 0.8 | 0.205 | 0.075 | 0.05 |
| FIG. 11 | 4.382 | 0.92 | 0.195 | 0.09 | 0.1 |
| FIG. 12 Circular D. | 4.382 | — | 0.168 | — | — |

* Hitting condition: Face Angle 0 deg., Club Path 4 deg. (Head speed 90 MPH)

Referring to Table 1, among dimples having new air channels according to the present disclosure, in a dimple of FIG. 5 which was filleted and had a deeper depth of the dimple as the depth of the channel becomes deeper, it was shown that the landing point was constant and the flight distance and the straightness were excellent. This is clearly compared with FIG. 8 showing the dimple having the conventional air channel. In addition, in the dimple having the conventional air channel, the flight distance is significantly deteriorated, the influence of the wind is more due to a high peak, and the landing point is shown by falling into one side.

Referring to Table 2, first, in the golf ball having the conventional air channel (corresponding to the golf ball used in FIG. 8), the flight distance was too short to be excluded from comparison in the flight performance according to the slice hitting. This is to consider a phenomenon that the longer the distance, the more a deviation from the center line. FIG. 10 illustrates a result obtained by slice-hitting the same golf ball as FIG. 5, FIG. 11 illustrates a result obtained by slice-hitting the same golf ball as FIG. 7, and FIG. 12 illustrates a result obtained by slice-hitting a golf ball using conventional general circular dimples like FIG. 9, and it can be seen that the degree of deviation from the center line is indicated by SIDE, and the average value at the landing point is much different even if the slice-hitting is performed under the same condition.

As described above, according to the present disclosure, the problem of durability deterioration at the outer tip of the air channel over the entire surface of the golf ball is solved by the air channel structure in which the outer tip is chamfered or filleted. Meanwhile, it is possible to minimize the influence of wind at the outer tip of the air channel and greatly improve flight stability related with slice prevention, straightness and excellent impact point while ensuring a sufficient flight distance by uniformalizing pressure drag. In addition, the depth of the dimple itself is selectively made deeper than the depth of the dimple of the conventional golf ball with the air channel in accordance with the chamfering or filleting of the outer tip of the air channel, thereby minimizing a loss of lift force and a loss of a flight distance.

The above description relates to a specific embodiment of the present disclosure. While the present disclosure has been particularly shown and described with reference to exemplary embodiments thereof, it is to be understood by those skilled in the art that the present disclosure is not limited to the disclosed exemplary embodiments, but, on the contrary, is intended to cover various modifications and equivalences without departing from the spirit and scope of the appended claims. Therefore, it is to be understood that all such modifications and alterations are included within the scope of the present disclosure disclosed in the appended claims or their equivalents.

What is claimed is:

1. A golf ball comprising:

a plurality of dimples; and air channels connecting adjacent dimples, wherein the air channel includes a bottom surface and an outer tip, wherein the outer tip of the air channel, taken from a plan view of the golf ball, is extending between and connected to two adjacent ones of the dimples, and the outer tip of the air channel between the dimples, taken from a sectional view of the golf ball, has a rounded shape with a fillet radius smaller than 0.1 mm and greater than 0, and wherein the depth of the dimple is 0.18 to 0.25 mm and the depth of the air channel is 5 to 50% of the dimple depth and is in a range of 0.01 mm to 0.125 mm.

2. The golf ball of claim 1, wherein the width of the air channel is 5 to 20% of the dimple diameter.

3. The golf ball of claim 1, wherein the diameter of the dimple is 2.54 mm or more and the width of the air channel is 0.1 mm to 1.2 mm.

4. The golf ball of claim 1, wherein the bottom surface of the air channel has a planar, triangular or curved cross-sectional profile.

5. The golf ball of claim 1, wherein the air channels are provided such that all of the dimples are connected to at least one of the air channels.

6. The golf ball of claim 1, wherein the air channels are provided such that at least one of the dimples is not connected to any of the air channels.

7. The golf ball of claim 6, wherein an area rate of the dimples which are connected to the air channels is 79% or more based on the entire surface area.

* * * * *